US008438964B1

(12) United States Patent
Nolte et al.

(10) Patent No.: US 8,438,964 B1
(45) Date of Patent: May 14, 2013

(54) GUN PORTS

(75) Inventors: Roger Allen Nolte, Concord, NC (US); Greg Groening, Salisbury, NC (US)

(73) Assignee: Kontek Industries, Inc., Kannapolis, NC (US)

( * ) Notice: Subject to any disclaimer, the term of this patent is extended or adjusted under 35 U.S.C. 154(b) by 147 days.

(21) Appl. No.: 13/153,424

(22) Filed: Jun. 5, 2011

(51) Int. Cl.
*F41H 5/26* (2006.01)

(52) U.S. Cl.
USPC ..... 89/36.14; 89/36.04

(58) Field of Classification Search ..... 89/36.04, 89/36.07, 36.13–36.15
See application file for complete search history.

(56) References Cited

U.S. PATENT DOCUMENTS 2,897,888 A * 8/1959 Dragonuk ..... 160/99
3,262,227 A * 7/1966 Pentecost ..... 49/354
3,559,528 A * 2/1971 Cunningham ..... 89/40.03
4,132,446 A * 1/1979 Bauer ..... 296/155
4,316,404 A * 2/1982 Medlin ..... 89/36.08
4,336,644 A * 6/1982 Medlin ..... 29/401.1
4,352,316 A * 10/1982 Medlin ..... 89/36.02
4,771,672 A 9/1988 Miller
4,771,673 A 9/1988 Miller
5,307,725 A * 5/1994 Desmond et al. ..... 89/36.14
6,425,311 B1 7/2002 Caron
8,065,948 B1 * 11/2011 Baptista et al. ..... 89/36.14

* cited by examiner

*Primary Examiner* — Michael David
(74) *Attorney, Agent, or Firm* — Barclay J. Tullis

(57) ABSTRACT

A gun port having a door with spaced-apart plates provides armor against ballistic weapons and explosive blasts. Such a gun port is useful in defense of armored vehicles, armored buildings, and other installations. Sliding or rolling such a gun port door across a gun port opening horizontally on guide rails allows for ease of use by both persons who are left handed or right handed. A door slide sub-assembly is easily mounted or un-mounted from a separate port frame installed in a vehicle or building wall, providing easy repair of the door and door slide sub-assembly, and easier replacement of the port frame.

20 Claims, 5 Drawing Sheets

GUN PORTS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention(s) relates to gun ports, and in particular to gun ports with blast-resistant doors and/or to gun ports with doors that slide or roll horizontally into and out of a closed position over a gun port opening, useful in defense of armored vehicles, armored buildings, and other installations.

2. Description of the Related Art

Gun ports are well known in the art for both military and non-military application. A gun port permits discharge of a fire arm through an opening defined within the gun port whenever the gun port is in an open position. The gun port secures the port against passage of a bullet or other unwanted object or fluid whenever the gun port is in a closed position. Typically gun ports include a door as a closure shield secured on either an interior or exterior surface of a support apparatus such as an exterior wall of an armored vehicle or the exterior wall of a building. The door is often actuated by an operator of the gun port standing or sitting next to an interior surface of the support apparatus, such as inside the armored vehicle or building. Examples of the prior art in gun ports are provided by U.S. Pat. Nos. 4,771,672; 4,771,673; and 6,425,311. In all three of these examples, the door consists of a single plate of metal. The first example discloses a door (or "closure plate") that is a single plate that is slid upward to open, and downward to close. The second example discloses a door (or "closure") that is a single plate that is pivoted inward and downward to open, and upward and outward to close. The third example discloses a door (or "closure shield") that is a single plate mounted on the outside of the exterior wall and that rotates parallel to the wall in a first rotational direction to open, and in the reverse direction to close.

The prior art does not disclose gun ports designed to withstand explosive blasts from military or terrorist threats. What are needed are gun ports that can withstand explosive blasts, and at the same time are constructed of preassembled subassemblies that enable easy installation and replacement.

BRIEF SUMMARY OF THE INVENTION

The invention(s) is pointed out with particularity in the appended claims. However, some aspects of the invention(s) are summarized in the following descriptions of some possible implementation examples and aspects.

One implementation of the invention(s) includes a gun port comprising a port frame coupled to a movable, blast-resistant door. The door can be rolled or slid in either of two opposite directions and comprises at least two spaced-apart plates, wherein the at least two spaced-apart plates can be made of steel. The door can be moved out of the way of a port opening in either of two directions along guide rails, and a handle is included that can be grasped by either a user's left or right hand and used to move the door either to the left or to the right. The door position can be latched into any of multiple, fixed locations and can be restrained by at least an upper or lower protection bar. The door can also be restrained by left and right end plates. The gun port can optionally further comprise one or more drip bars, at least one ricochet bar, and at least one rain slot.

Objects and Advantages of the Invention

Objects and advantages of the present invention(s) are numerous. One object and advantage is a port door that has been tested to withstand ballistic projectiles and explosive blasts from outside the port. The blast testing has shown that a gun port of the present invention(s) can reduce outside blast pressures of 25 psi outside down to pressures inside of less than 0.5 psi. This is accomplished by constructing a gun port door that is close fitting against a port frame. It is also accomplished with a door that is constructed with not just with one steel plate to close the opening of the port, but with a stack of two or more spaced-apart steel plates, wherein the steel can be A36 carbon steel rather than more exotic and expensive steels, and wherein the space between adjacent plates can simply be air space and spacer standoffs. In one such design, an outer plate of 1.5 inch (3.81 cm) thickness is spaced 1.625 inch (4.13 cm) from an inside plate of 1 inch (2.54 cm) thickness. A second object and advantage is a door handle that can be manually moved left or right to open a closed port with either hand of a shooter or other user. A third object and advantage is a door that moves on rollers or slides, wherein the rollers or slides are protected by being located between the spaced apart plates of the door. Within this disclosure, "slide" can imply either sliding or rolling. A fourth object and advantage is a door sub-assembly, including movement guides, that can be removed and replaced easily from the inside or safe-side of its port frame. A fifth object and advantage is a door that can be latched into a fixed position at any one of a number of alternative stop positions, allowing the door to be opened by different amounts from the fully closed position. Additional advantages include optional inclusion of one or more ricochet stops, which may include a drip slot, and drip bars (also called drip ringlets).

The various features and further advantages of the present invention(s) and their preferred embodiments will become apparent to ones skilled in the art upon examination of the accompanying drawings and the following detailed description. It is intended that any additional advantages be incorporated herein. The contents of the following description and of the drawings are set forth as examples only and should not be understood to represent limitations upon the scope of the present invention(s).

BRIEF DESCRIPTION OF THE SEVERAL VIEWS OF THE DRAWINGS

The foregoing objects and advantages of the present invention(s) of gun ports may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. Within these drawings.

DETAILED DESCRIPTION OF THE INVENTION

Figure 1:
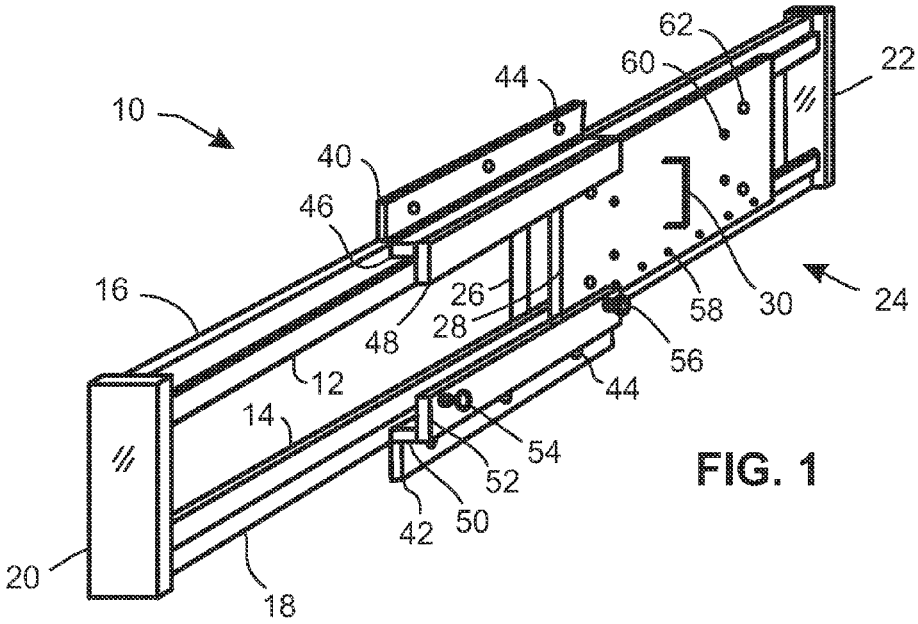
FIG. 1 shows a perspective view from the inside and from the left side of a gun-port door on a door slide sub-assembly.

The following is a detailed description of the invention(s) and its preferred embodiments as illustrated in the drawings. While the invention(s) will be described in connection with these drawings, there is no intent to limit it to the embodiment or embodiments disclosed. On the contrary, the intent is to cover all alternatives, modifications and equivalents included within the spirit and scope of the invention(s) as defined by the appended claims.

FIG. 1 shows a perspective view from the inside and from the left side of a gun-port door 24 that is part of a door slide sub-assembly 10. The door 24 rolls or slides along upper guide rail 12 and lower guide rail 14 that are co-parallel to one another and supported by upper beam 16 and lower beam 18 respectively. The upper and lower beams 16,18 are fastened to left end plate 20 on the left, and to right end plate 22 on the right. The door 24 itself is shown comprising an outer door plate 26 spaced apart from an inner door plate 28 and a door handle 30. There are an upper support plate 40 and a lower support plate 42 fastened to the upper beam 16 and lower beam 18 respectively; these support plates will be seen in FIGS. 5, 6, 10, and 11 to be the means by which this door slide sub-assembly 10 can be mounted to a port frame 80 by multiple fastener holes such as a fastener hole 44. An upper spacer bar 46 is fastened to the upper beam 16, and an upper protection bar 48 is fastened to the upper spacer bar 46. A lower spacer bar 50 is fastened to the lower beam 18, and a lower protection bar 52 is fastened to the lower spacer bar 50. These protection bars 48,52 help to keep the door 24 from being blown off of the guide rails 12,14 when the door is subjected to forces of an explosive blast from outside the door 24 pushing toward the inside of the door 24. The upper and lower beams 16,18 and the upper and lower guide rails 12,14 also help in this regard. "Inside" is on the side of the door 24 that faces the foreground of this perspective view, while "outside" is on the opposite side of the door 24 that faces the background of this view. There is a left spring latch 54 installed within the left side of the lower protection bar 54, and a right spring latch 56 installed within the right side of the same lower protection bar 54. Spring latches 54,56 can be used to engage latch engagement holes such as the latch engagement hole 58; multiple latch engagement holes are shown lined up along a direction parallel to the bottom edge of the inner door plate 28. The outer and inner door plates 26,28 are held spaced apart by pipe spacers 64 shown in FIG. 6, and the door 24 uses door rollers 66 to move along the guide rails 12,14 (these rollers 66 are also shown in FIG. 6). In this view, the holes for four spacer fasteners 60 and four roller fasteners 62 can be seen on the inside of the inner door plate 28. Each of the set of four spacer fasteners 60 and the set of four roller fasteners 62 are arranged in a rectangular grid pattern. The door 24 is a blast-resistant door. Within this disclosure, "blast-resistant door" is defined to mean a door comprising two or more generally co-parallel layers of armor spaced apart from one-another.

Figure 2:
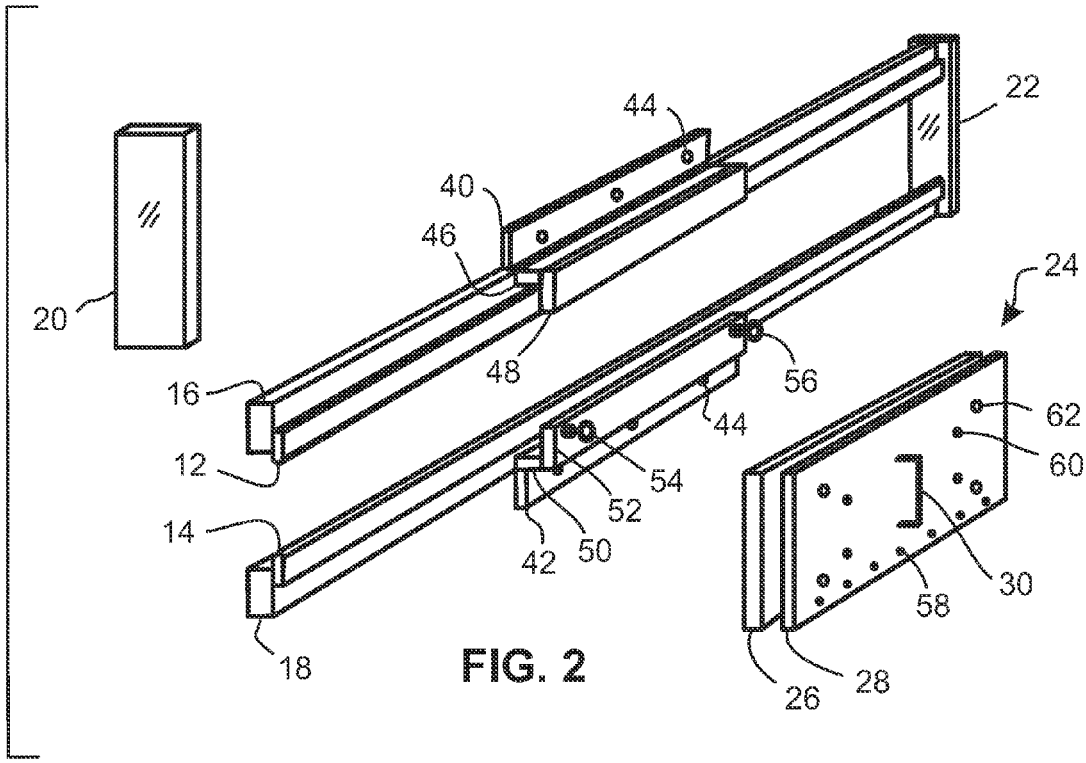
FIG. 2 shows a similar perspective view of the door and slide of FIG. 1 separated from their sub-assembly.

FIG. 2 shows a similar perspective view of the door 24, the left end plate 20, and the slides 12,14 separated from one another from their door slide sub-assembly 10 shown in FIG. 1.

Figure 3:
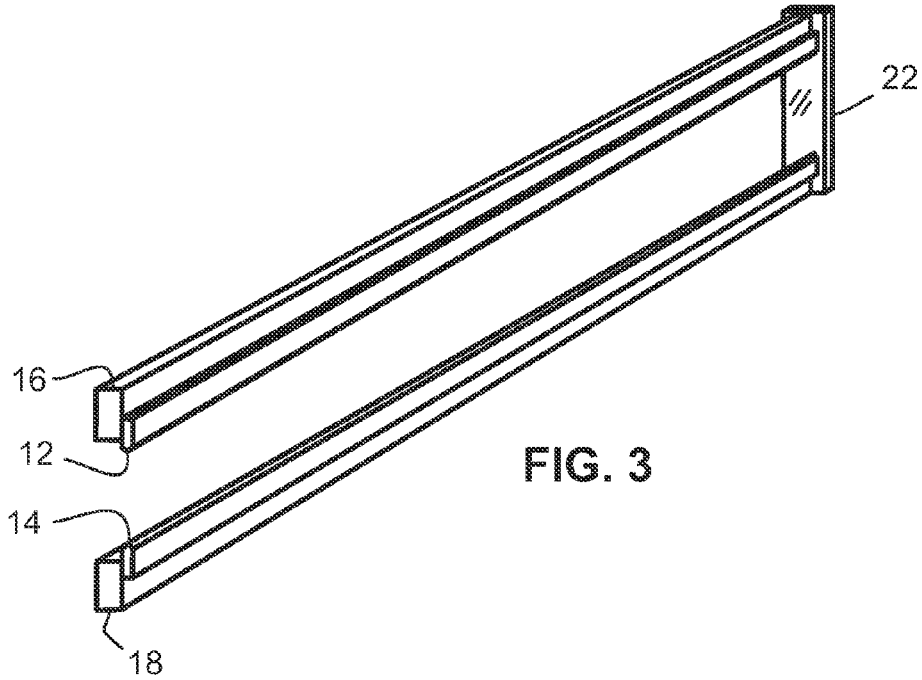
FIG. 3 shows a similar perspective view of the guide rails as used in the slide of the door slide sub-assembly of FIG. 1.

FIG. 3 shows a similar perspective view of the guide rails 12,14 as used in the door slide sub-assembly 10 of FIG. 1. This view also shows the beams 16,18 which support the guide rails 12,14. The right end plate 22 is shown supporting the right ends of the guide rails 12,14 and the beams 16,18.

Figure 4:
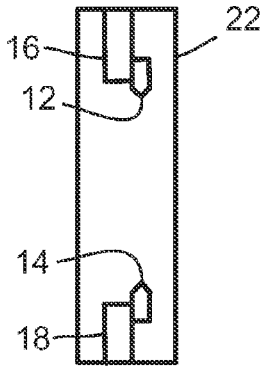
FIG. 4 shows an end view as viewed from the left of the parts shown in FIG. 3.

FIG. 4 shows an end view as viewed from the left of the parts shown in FIG. 3. These parts are the right end plate 22, the beams 16,18, and the guide rails 12,14.

Figure 5:
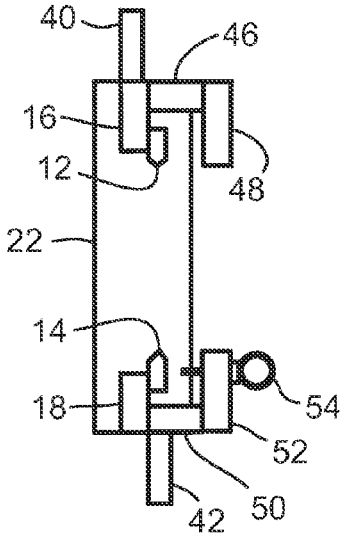
FIG. 5 shows a similar end view to that of FIG. 4, but of the door slide sub-assembly with the door and left end plate removed.
Figure 6:
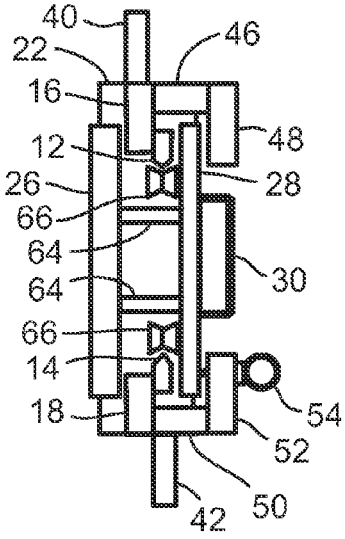
FIG. 6 shows a similar end view to that of FIG. 5, but with door included.

FIG. 5 shows a similar end view to that of FIG. 4, but of the door slide sub-assembly, but with the door 24 and left end plate 20 removed.

FIG. 6 shows a similar end view to that of FIG. 5, but with door 24 included (showing callout numbers for some of the parts of the door, but without the callout number 24 for the door as a whole). The parts of door called out are the outer and inner door plates 26,28, the door handle 30, pipe spacers 64, and rollers 66.

Figure 7:
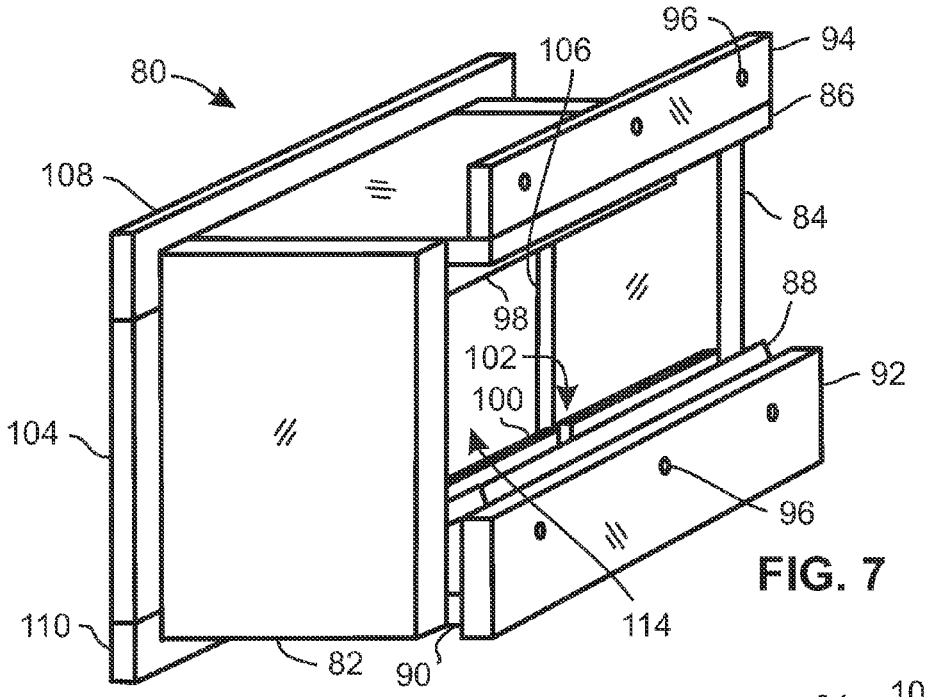
FIG. 7 shows a perspective view from the inside and from the left side of a gun port frame and opening.

FIG. 7 shows a perspective view from the inside and from the left side of a gun port frame 80 and opening 114. In one implementation, the size of the opening 114 (or window) measures approximately 12 inches by 12 inches (30 cm by 30 cm). The gun port frame 80 comprises a left side wall 82 and a right side wall 84 as well as a ceiling 86, a sloped inner floor 88, and a horizontal outer floor 90. The sloped inner floor 88 allows for a smaller area of opening on the inside than on the outside of the opening 114. On the sloped inner floor 88, near the inside of the opening 114, is a ricochet bar 100 to stop projectiles from passing through the opening 114 should they first strike the sloped inner floor 88. A rain slot 102 divides left and right portions of the ricochet bar 100 and allows water to drain from accumulating behind the ricochet bar 100. In this view a lower edge of a drip bar 98 can be seen within the upper part of the opening 114; drip bars such as the one visible are used to trap rain drops that might otherwise enter the opening 114 from outside the gun port frame 80. Attached to the ceiling 86 is an upper mounting plate 94, and attached to the sloped inner floor 88 and to the horizontal outer floor 90 is a lower mounting plate 92. Both mounting plates 92,94 include mounting holes such as mounting hole 96. These mounting plates 92,94 are where the upper and lower support plates 40,42 of the door slide sub-assembly 10 attach (as in FIG. 1). Facing outward from the port frame 80 is a left exterior flange 104 attached to the left side wall 82; a right exterior flange 106 attached to the right side wall 84; a top exterior flange 108 attached to the ceiling 86 and to both left and right side walls 82,84; and a bottom exterior flange 110 attached to the horizontal outer floor 90 and to both left and right side walls 82,84.

Figure 8:
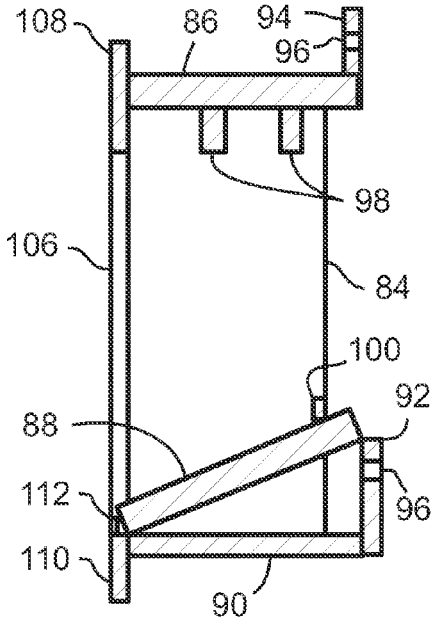
FIG. 8 shows a cross-sectional view from the left side of the gun port frame shown in FIG. 7.

FIG. 8 shows a cross-sectional view from the left side of the gun port frame 80 shown in FIG. 7. In this view, a filler strip 112 is seen welded between the lower end of the sloped inner floor 88 and the bottom exterior flange 110 providing a more smoothly contoured surface between these two other parts 88,112.

Figure 9:
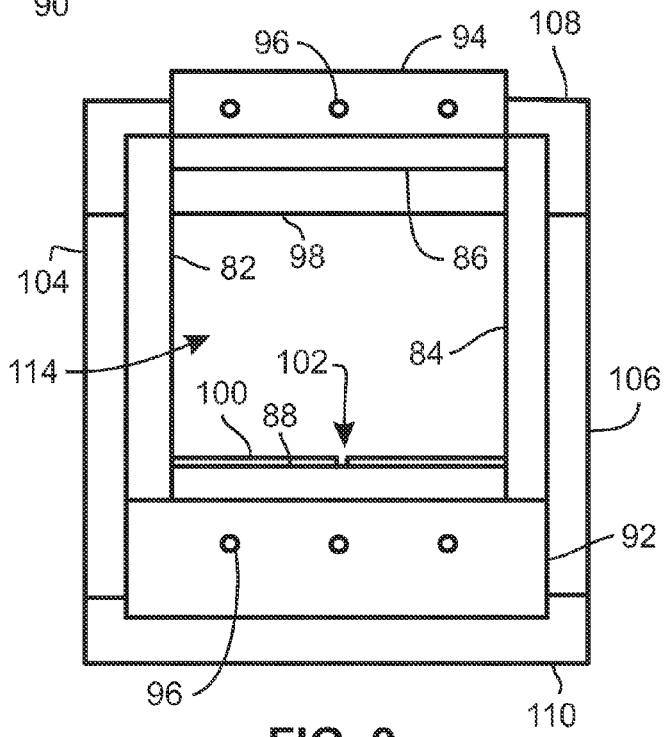
FIG. 9 shows a view looking toward the outside from the inside or safe side of the gun port frame shown in FIG. 7, and showing the opening through the gun port frame.

FIG. 9 shows a view looking toward the outside from the inside or safe side of the gun port frame 80 shown in FIG. 7, and showing the opening 114 through the gun port frame 80.

Figure 10:
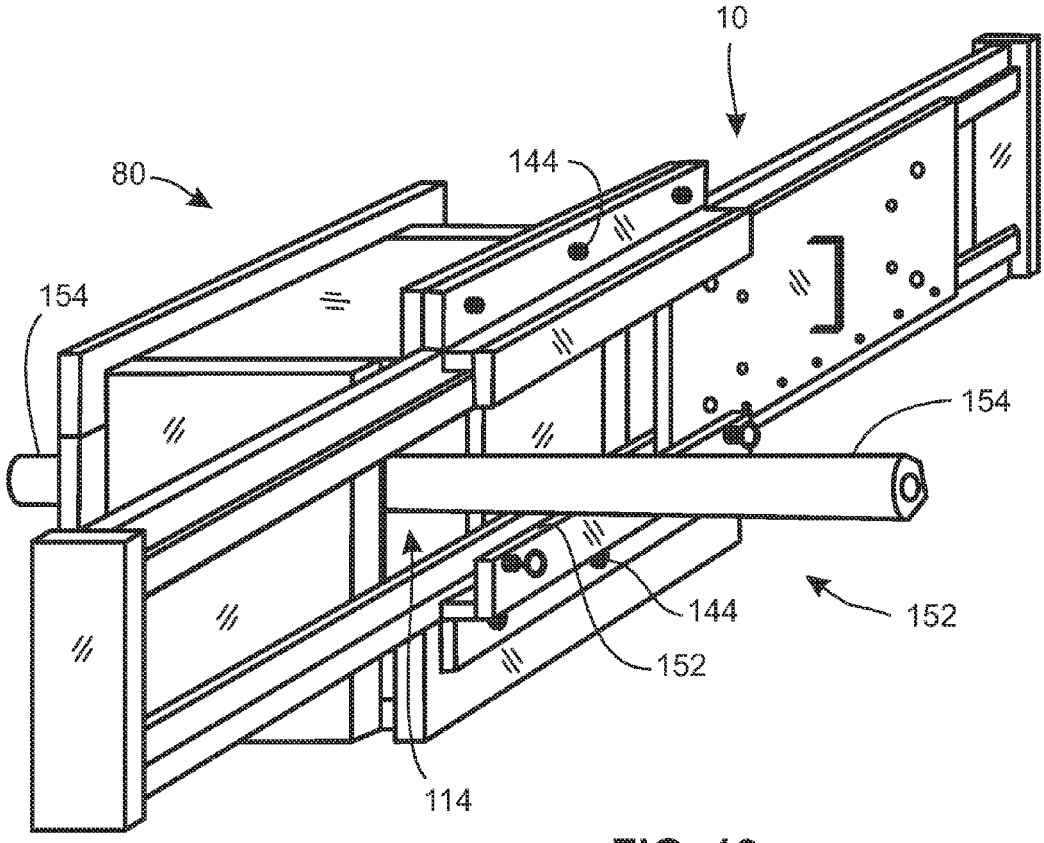
FIG. 10 shows the perspective view of FIGS. 1 and 7 but showing the door slide sub-assembly mounted on the port frame, and showing a gun barrel directed through the gun port opening.

FIG. 10 shows the perspective view of FIGS. 1 and 7 but showing the door slide sub-assembly 10 mounted on the port frame 80, and showing a gun barrel 154 directed through the gun port opening 114. Mounting bolts 144 are shown holding the door slide sub-assembly 10 to the inside of the port frame 80.

Figure 11:
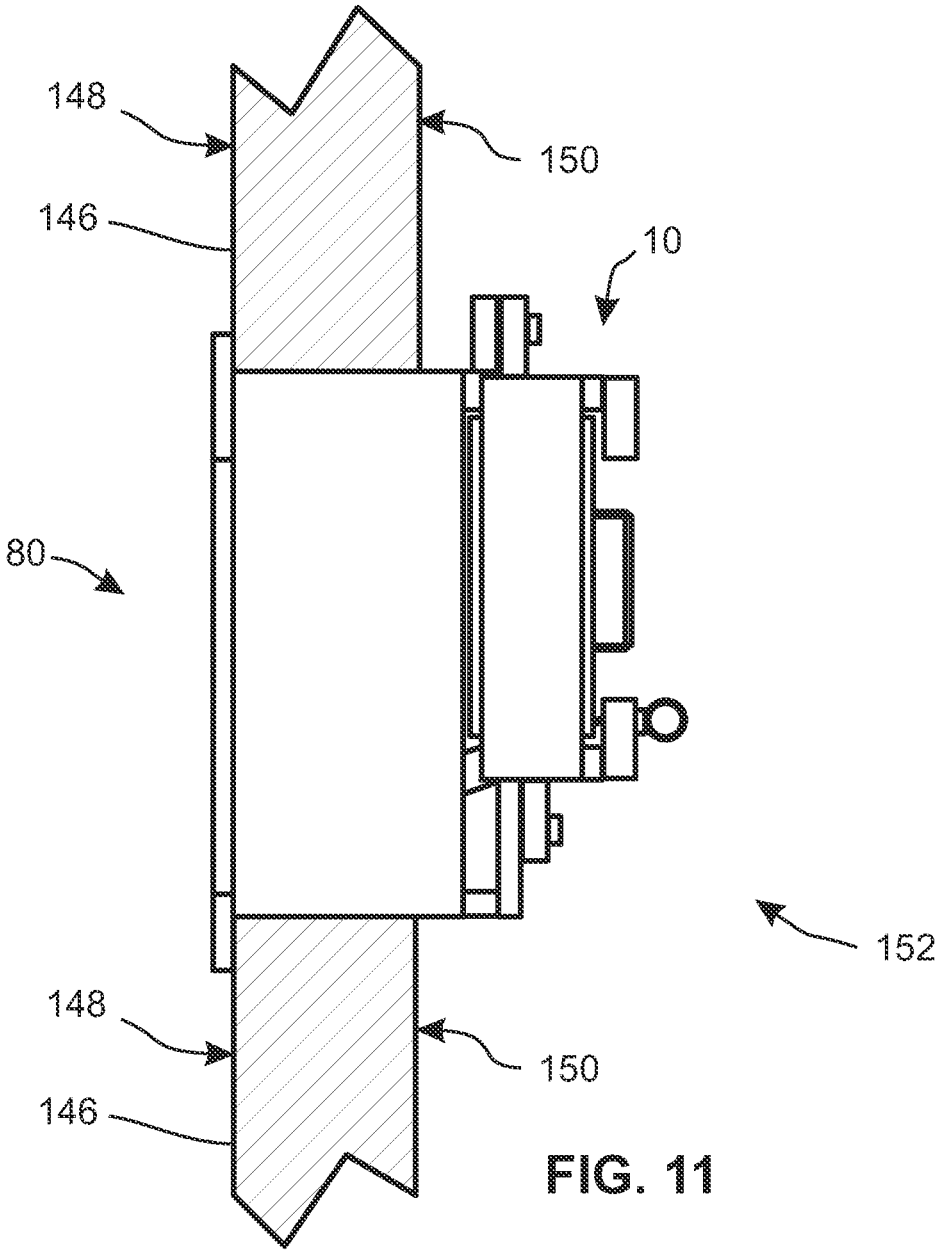
FIG. 11 shows a view from the left side of a gun port installed into a wall of a vehicle or building, where the wall is shown in cross-section.

FIG. 11 shows a view from the left side of a gun port 152 installed into a wall 146 of a vehicle or building, where the wall 146 is shown in cross-section and having an outside wall surface 148 and an inside wall surface 150. The exterior flanges of the gun port frame 80 are shown fitted against the outside wall surface 148.

Other embodiments may include within the space between plates of the door 24 shock absorbing ceramic, plastic, or metal foam material, or even laminations of sheets of various materials. Additional features may be added, such as a gun rest. And the top, bottom, or sides in general of a port frame 80 may be angled to create a port opening 114 that is larger inside than outside, as to create an embrasure.

Embodiments of the present invention(s) include methods of using gun ports of the present invention(s). One such method comprises steps of: a) manually sliding a port door along guide rails to at least a partially open position from a closed position and thus exposing a opening in a gun port frame, b) inserting the barrel of a gun through the opening, and c) shooting the gun. Another such method comprises steps of a) removing the barrel of a gun from an opening in a gun port and b) manually sliding a port door along guide rails to a closed position.

Although specific embodiments of the invention(s) have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention(s). It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention(s) includes any other applications in which the above structures and methods are used.

We claim:

1. A gun port comprising a port frame coupled to a movable, blast-resistant door;

wherein the door comprises at least two spaced-apart plates that are made of steel;

wherein the door can be rolled or slid along guide rails in either of two opposite directions;

wherein the door can be moved out of the way of a port opening in either of the two directions; and wherein the door comprises a handle that can be grasped by either a left or right hand and used to move the door either to the left or right.

2. The gun port of claim 1, wherein the door position can be latched into any of multiple, fixed locations.

3. The gun port of claim 1, wherein the door location is restrained by at least an upper or lower protection bar.

4. The gun port of claim 1, wherein the door location is restrained by left and right end plates.

5. The gun port of claim 1, further comprising one or more drip bars.

6. The gun port of claim 1, further comprising at least one ricochet bar.

7. The gun port of claim 6, further comprising at least one rain slot.

8. A gun port comprising:

a. a port frame suitable for fitting into a wall to create a gun port opening;

b. a blast-resistant door that is comprised of two or more co-parallel and spaced-apart steel plates; and c. a moving-door assembly comprising at least one linear rail to guide movement of the door;

wherein the moving-door assembly is mounted to the port frame; and wherein the door is restrained by at least an upper or lower protection bar.

9. The gun port of claim 8, wherein the door can be rolled or slid in either of two opposite directions.

10. The gun port of claim 8, wherein the door comprises a handle that can be grasped by either a left or right hand and used to move the door either to the left or to the right.

11. The gun port of claim 8, wherein the door location is restrained by left and right end plates.

12. The gun port of claim 8, further comprising one or more drip bars.

13. The gun port of claim 8, further comprising at least one ricochet bar.

14. A blast-resistant gun port door to a gun port opening in a gun port frame;

wherein the door is configured to move to an opened position along at least one guide rail;

wherein the at least one guide rail is mounted to at least either an upper or lower portion of the port frame;

wherein the door can open by moving in either of two different directions along the at least one guide rail; and wherein the door is restrained by upper and lower protection bars extending from the port frame to prevent the door from being blown open by a blast or projectile.

15. The blast-resistant gun port door of claim 14, wherein the door comprises two or more spaced apart steel plates.

16. The blast-resistant gun port door of claim 14, wherein the door comprises a handle that can be grasped by either a left or right hand and used to move the door either to the left or to the right.

17. The blast-resistant gun port door of claim 14, wherein the door location is restrained by left and right end plates.

18. The blast-resistant gun port door of claim 14, further comprising one or more drip bars.

19. The blast-resistant gun port door of claim 14, further comprising at least one ricochet bar.

20. The blast-resistant gun port door of claim 14, wherein the door can be rolled or slid in either of two opposite directions.

* * * * *